US005415412A

United States Patent [19]

McMahon

[11] Patent Number: 5,415,412

[45] Date of Patent: May 16, 1995

[54] APPARATUS FOR DETERMINING BATTING AND BASE STEALING OUTCOMES IN A BASEBALL BOARD GAME

[76] Inventor: Brad J. McMahon, 30 Haverhill Rd., North Kingstown, R.I. 02852

[21] Appl. No.: 307,513

[22] Filed: Sep. 16, 1994

[51] Int. Cl.[6] ..... A63F 3/00

[52] U.S. Cl. ..... 273/244; 273/259; 273/146

[58] Field of Search ..... 273/242, 243, 244, 259, 273/146

[56] References Cited

U.S. PATENT DOCUMENTS

| | | | |
|---|---|---|---|
| 203,368 | 5/1878 | Peirce . | |
| 1,536,639 | 5/1925 | Van Beek . | |
| 1,547,313 | 7/1925 | Foster . | |
| 1,581,189 | 4/1926 | Fuchs . | |
| 1,692,402 | 11/1928 | Barthel | 273/146 |
| 2,024,541 | 12/1935 | Silkman | 273/146 |
| 2,457,168 | 12/1948 | Meyer . | |
| 2,490,737 | 12/1949 | Muthart . | |
| 2,528,029 | 10/1950 | Brown | 273/146 |
| 3,642,286 | 2/1972 | Moore | 273/146 |
| 3,716,236 | 2/1973 | Pangborn | 273/146 X |
| 3,734,501 | 5/1973 | LaMonica . | |
| 4,000,897 | 1/1977 | York . | |
| 4,210,335 | 7/1980 | Licciardi . | |
| 4,230,316 | 10/1980 | Harper . | |
| 4,261,569 | 4/1981 | Frohlich . | |
| 4,653,755 | 3/1987 | Panella et al. . | |
| 4,813,678 | 3/1989 | Collazo et al. | 273/146 X |
| 4,822,043 | 4/1989 | Carter | 273/146 X |
| 5,071,136 | 12/1991 | Lott . | |
| 5,092,596 | 3/1992 | Bucaria | 273/146 X |

FOREIGN PATENT DOCUMENTS

| | | | |
|---|---|---|---|
| 2194454 | 3/1988 | United Kingdom | 273/146 |

*Primary Examiner*—William E. Stoll
*Attorney, Agent, or Firm*—Salter & Michaelson

[57] ABSTRACT

A baseball board game utilizes a first set of six-sided dice and a sectored spinner to simulate the statistical probabilities of hits, walks, outs, and strikeouts. The first set of dice is coded with specific designations so that the possible combinations of the designations determine whether the player has achieved a hit, walk, strikeout, or out. The spinner is divided into labeled sectors to represent different types of hits. Once it has been determined that a player has achieved a hit by rolling the dice, the player then spins the spinner to determine what type of hit is achieved. The labeled sectors of the spinner are arranged to accurately represent the statistical distribution of the type of hits. The board game further utilizes a second set of dice to determine the outcome of a steal attempt. The second pair of dice is coded with specific designations so that the possible combinations of the designations determine whether the player has successfully stolen a base. The statistical probability of the outcomes of the dice sets and the spinner accurately simulates the actual probabilities of Major League Baseball ® statistics. The board game also uses two sets of player cards, which are preferably supplemented, or replaced, by the player's own baseball cards.

10 Claims, 4 Drawing Sheets

APPARATUS FOR DETERMINING BATTING AND BASE STEALING OUTCOMES IN A BASEBALL BOARD GAME

BACKGROUND AND SUMMARY OF THE INVENTION

The instant invention relates to baseball board games and more particularly to dice and spinner apparatus for determining batting and base stealing outcomes during play of a board game simulating a baseball game.

A wide variety of baseball board games have heretofore been known in the art. In this connection, many of the currently available baseball board games are based on Major League Baseball ® (Major League Baseball is a registered trademark of Major League Baseball Properties, Inc.) probabilities of hitting, pitching, fielding, stealing and other specific game circumstances in order to provide more accurate and realistic game play. However, due to the highly statistical nature of these games, the games rules are often too complex for a typical 4 to 10 year old child to comprehend, execute and enjoy. As a result, the majority of children age 10 and under cannot take part in the play of these statistically oriented games.

Furthermore, these board games do not allow for the optional use of collectible baseball cards as an integral part of the game procedures. It is known that the 4 to 10 year old age group is one of the biggest collectors of baseball cards, and it is believed that a board game in which the players could utilize their own collections of baseball cards would have significant play value.

Accordingly, it is an object of the instant invention to provide a baseball board game and apparatus for determining play outcomes which matches the accuracy of Major League Baseball ® hitting, pitching, and base stealing probabilities with the cognitive skill level of the 4 to 10 year old age group while also enabling integral use of a players own baseball card collection during play.

The board game utilizes a first set of six-sided dice to simulate the statistical probabilities of hits, walks, outs, and strikeouts. The first set of dice is coded with specific designations so that the possible combinations of the designations determine whether the player has achieved a hit, walk, strikeout, or out. Once it has been determined that a player has achieved a hit by rolling the dice, a sectored spinner is provided to determine what type of hit is achieved. The spinner is divided into labeled sectors to represent different types of hits. The labeled sectors of the spinner are arranged to accurately represent the statistical distribution of the type of hits. The board game further includes a second set of dice to simulate the statistical probability of stealing a base. The second set of dice is coded with specific designations so that the possible combinations of the designations determine whether the player has successfully stolen a base. The statistical probability of the outcomes of the first set of dice and spinner (batting) and the second set of dice (base stealing) accurately simulates the actual probabilities of Major League Baseball ® statistics. The board game also uses two sets of fictitious player cards, which are preferably supplemented, or replaced by, the players own collectible baseball cards. As in a real baseball game, the players take turns at bat and in the field. The field is represented by an illustrated cardboard playing surface or vinyl mat.

Other objects, features and advantages of the invention shall become apparent as the description thereof proceeds when considered in connection with the accompanying illustrative drawings.

DESCRIPTION OF THE DRAWINGS:

In the drawings which illustrate the best mode presently contemplated for carrying out the present invention.

DESCRIPTION OF THE PREFERRED EMBODIMENT

Figure 1:
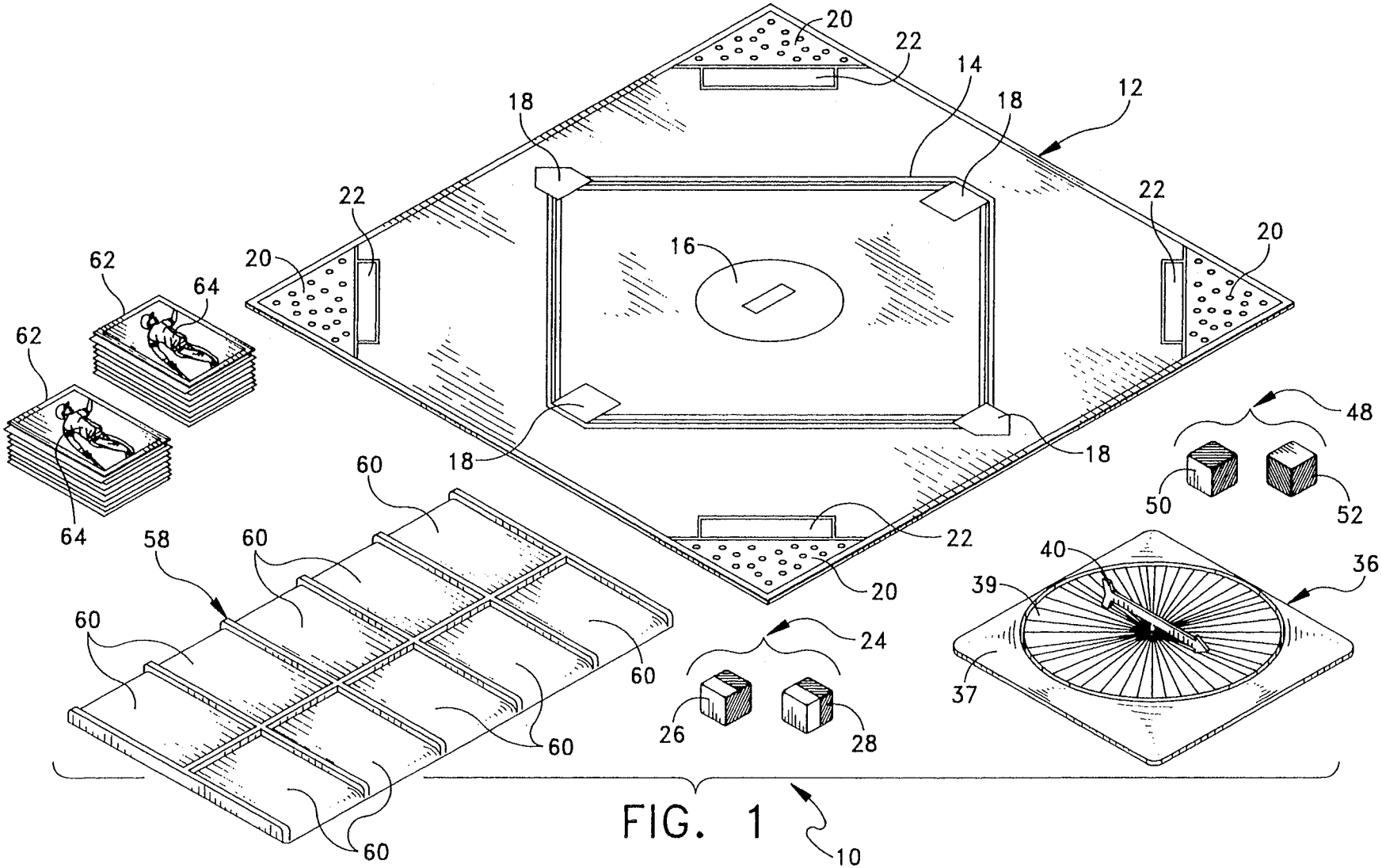
FIG. 1 is a perspective view of the board game apparatus of the instant invention.
Figure 2:
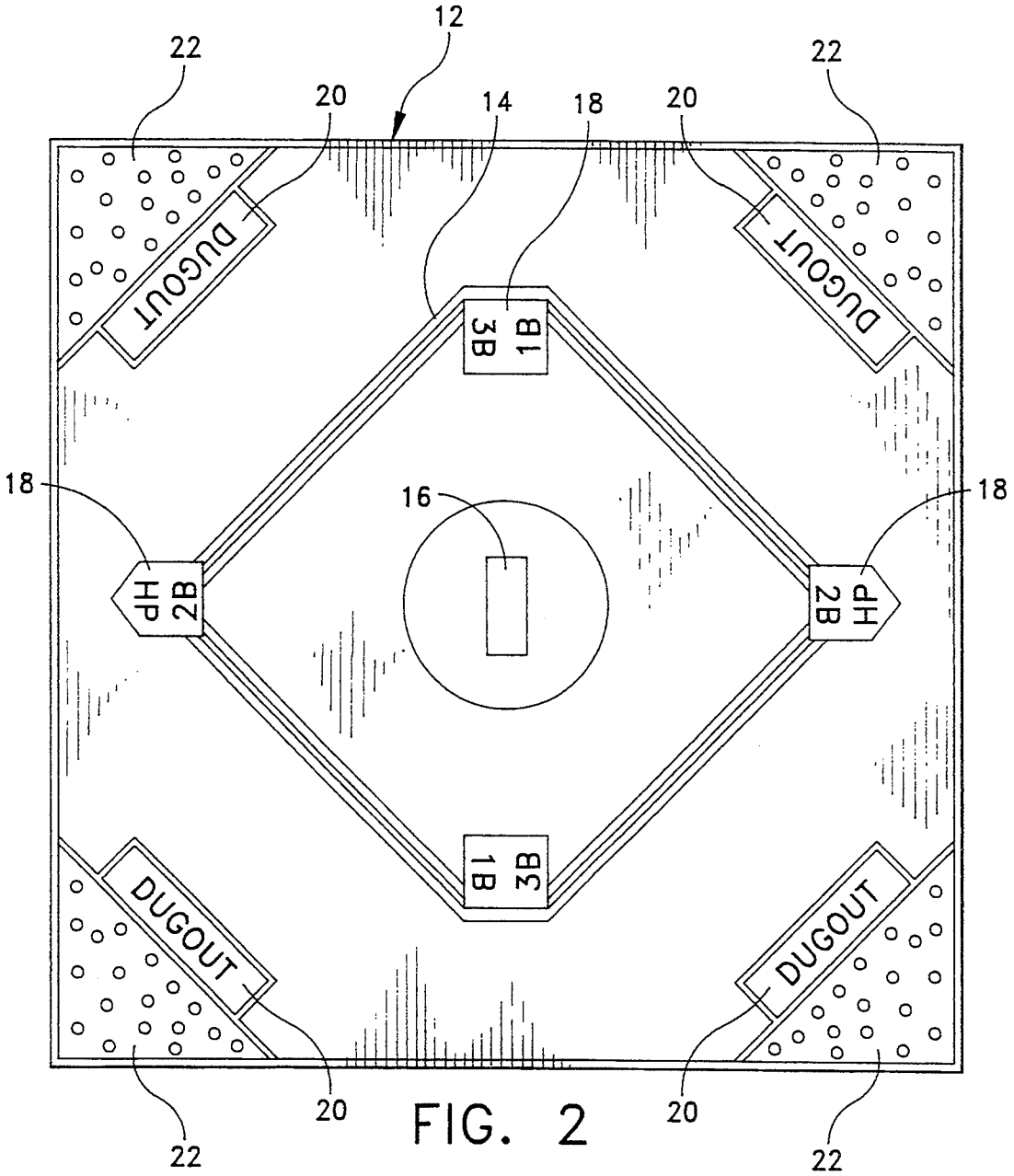
FIG. 2 is a plan view of the playing surface.

Referring now to the drawings, the baseball board game apparatus of the instant invention is illustrated and generally indicated at 10 in FIG. 1. As will hereinafter be more fully described, the instant board game apparatus includes means for determining batting and base stealing outcomes which accurately match the statistical probabilities of the outcomes in actual Major League Baseball ® games.

The board game apparatus 10 includes a rectangular playing surface generally indicated at 12 which is preferably approximately 18 inches by 18 inches. The playing surface 12 is preferably fashioned from a stiff paperboard material, such as cardboard. Illustrated on top of the playing surface 12 is a representation of baseball diamond 14 having a dual functioning infield so that two players can sit on opposite sides of the playing surface 12. The infield includes a central pitcher's mound 16 and four dual-functioning bases 18 spaced around the pitcher's mound 16. The playing surface 12 is also preferably illustrated with grandstands 20 and dugouts 22. In the alternative, the playing surface 12 can comprise a vinyl mat with appropriate illustrations thereon.

Figure 3:
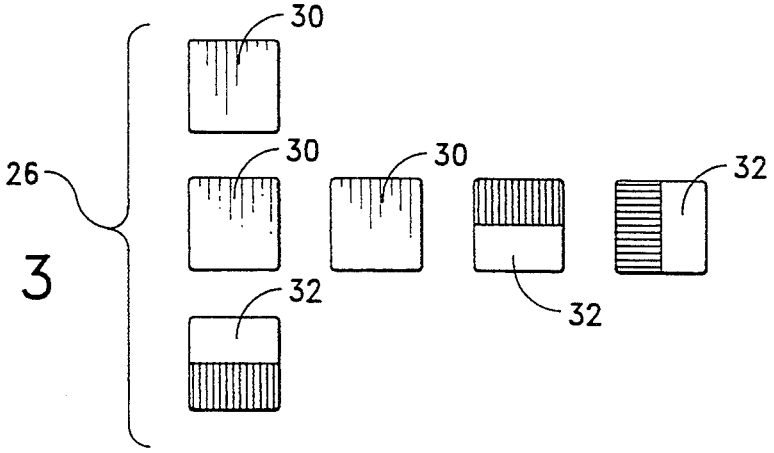
FIG. 3 is a collective view of the six sides of the first batting die.
Figure 4:
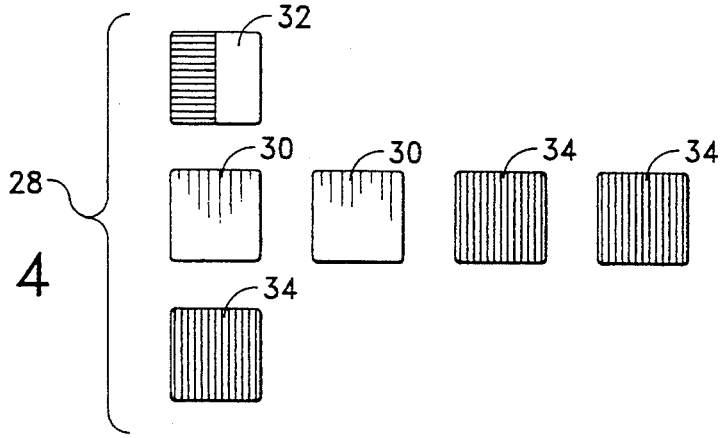
FIG. 4 is a collective view of the six sides of the second batting die.

The board game apparatus includes a first pair of six-sided dice generally indicated at 24 (FIG. 1) which are operative for accurately simulating the statistical probabilities of hits, walks, outs, and strikeouts in a Major League Baseball ® game. The first pair of dice 24 comprises first and second die, 26 and 28 respectively, (FIGS. 3 and 4) which are individually coded with specific designations so that the possible combinations of the designations determine whether a particular player has achieved a hit, walk, strikeout, or out. More specifically, the first die 26 (FIG. 3) has a first designation 30, preferably comprising solid white, on three of its six sides, and has a second designation 32, preferably comprising half black/half white, on the remaining three sides. The second die 28 (FIG. 4) has the first designation 30 (solid white) on two of its six sides, the second designation 32 (half black half white) on one side, and a third designation 34, preferably comprising solid black, on the three remaining sides. The combinations of different designations on the two dice 26 and 28 when rolled determine the outcome. In this connection, any time a solid white designation 30 appears on either die 26 or 28, the result is an out (24 outcomes out of possible 36 (66.67%)). However, when both dice 26 and 28 show a solid white designation 30, the out comprises a strike out (6 outcomes of possible 24 (25.00%)). When a solid black designation 34 appears on the second die 28 in combination with a half black/half white designation 32 on the first die 26, the result is a hit (9 outcomes out of possible 36 (25.00%)). When the half black/half white designation 32 on the second die 28 appears in combination with any of the three half black half white designations 32 on the first die 26, the result is a walk (3 outcomes out of a possible 36 (8.33%)). The following is a table comparing the results of the dice 26 and 28 versus the statistical averages of Major League Baseball ® in the years 1988 and 1989:

TABLE 1

| RESULT | MAJOR LEAGUE BASEBALL ® | ROLLED DICE | VARIANCE |
|---|---|---|---|
| Hit | 23.27% | 25.00% | (+)1.73% |
| Walk | 8.44% | 8.33% | (−)0.11% |
| Out | 68.29% | 66.67% | (−)1.62% |
| Strike-out | 20.84% | 25.00% | (+)4.16% |

Figure 5:
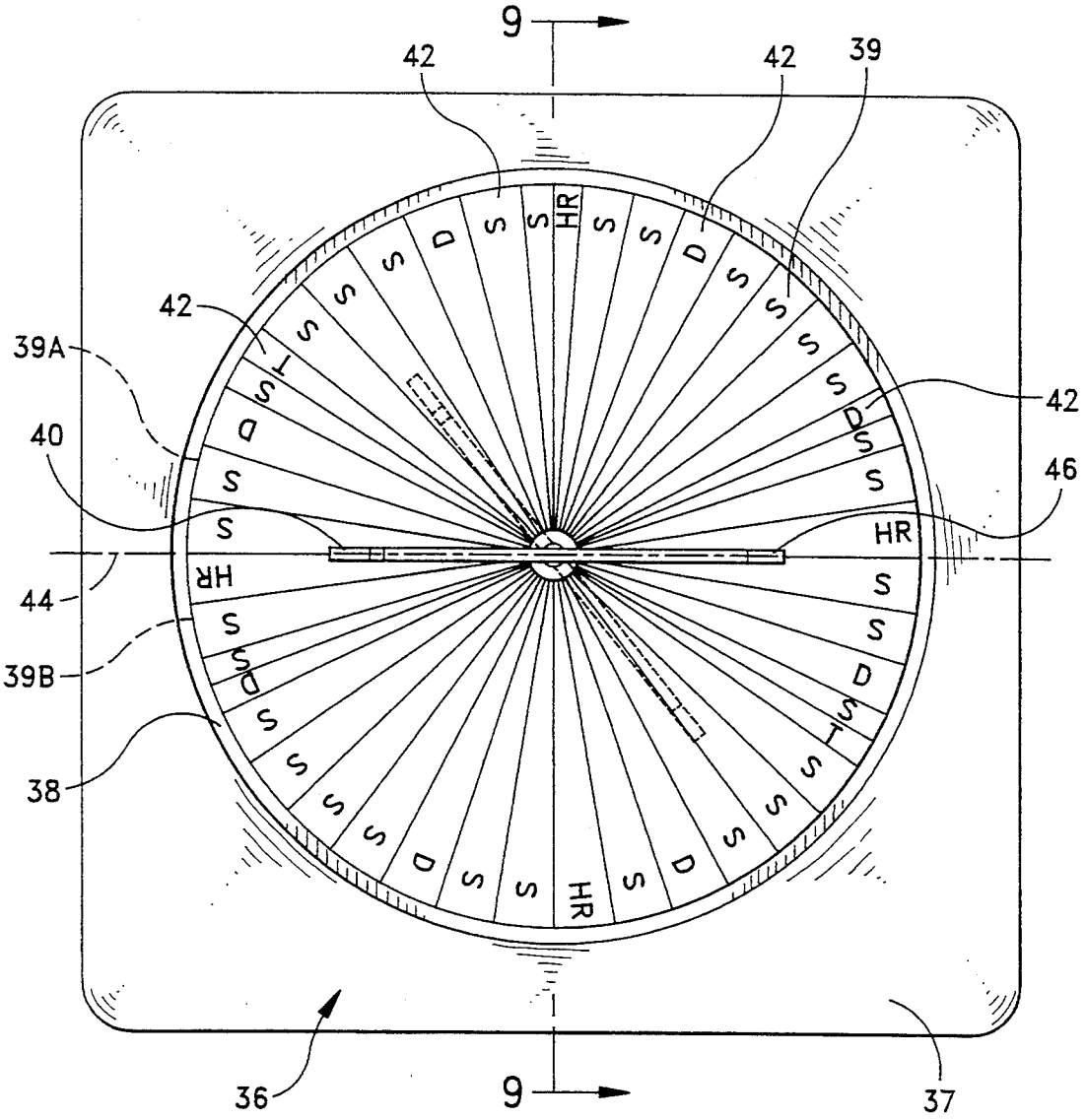
FIG. 5 is a plan view of the spinner of the apparatus.
Figure 9:
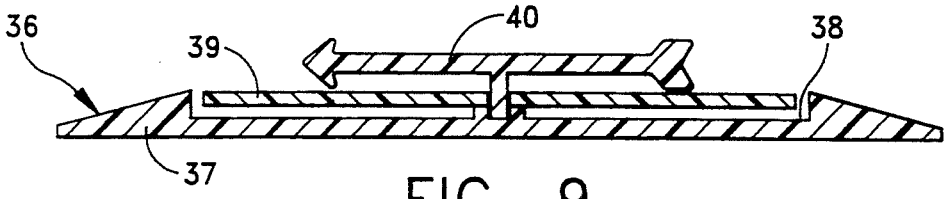
FIG. 9 is a cross-sectional view of the spinner apparatus taken along line 9—9 of FIG. 5.

Once it has been determined that a particular player has achieved a hit by rolling the dice 26 and 28, a sectored spinner assembly generally indicated at 36 (FIGS. 1 and 5) is provided to determine what type of hit is achieved. The spinner assembly 36 comprises a square base 37 having a cylindrical recess 38, a circular spinner card 39 received in base 37, and a spinner arm 40 rotatably mounted at the center of the recess 38 in base 37 (see FIG. 9). The spinner card 39 is preferably divided into forty sectors 42 each having an arc of nine degrees. The sectors 42 may be labeled with letters such as (S) for single, etc., or they may be color coded according to a predetermined color scheme. The sectors 42 of the spinner card 39 are preferably arranged and divided to accurately represent the type of hits according to Major League Baseball ® batting statistics. In this connection, the sectors 42 are divided 23 according to the following scheme:

TABLE 2

| Result | Number of Sectors | Percentage of Outcome |
|---|---|---|
| Single | 28.5 | 71.25 |
| Double | 7.0 | 17.50 |
| Triple | 1.0 | 2.50 |
| Home Run | 3.5 | 8.75 |

Accordingly, it can be seen that there are 28.5 sectors 42 on spinner card 39 representing singles, 17.5 sectors representing doubles, etc. In order to more fully distribute the sectors 42 about the circumference of the spinner card 39, the card 39 is divided first into halves (shown in broken lines) 39*a* and 39*b* along a centerline 44, and then the total number of sectors 42 per type of hit were divided in half so that an equal distribution of singles, doubles, triples, and home runs are distributed between the halves 39*a* and 38*b*. Each half segment of the base 38 therefor accurately represents the probability of achieving any one of the types of hits. It is pointed out that in some instances the sectors 42 were divided into half sectors. It is further pointed out that the arcuate sectors 42 could be distributed according any one of a plurality of different formats, including a conventional pie chart format wherein each type of hit (S, D, T and HR) would comprise a single sector 42 representing a predetermined total arc.

The following is a table comparing the results of the spinner 36 versus Major League Baseball ® batting statistics for the years 1988 and 1989:

TABLE 3

| RESULT | MAJOR LEAGUE BASEBALL ® | SPINNER | VARIANCE |
|---|---|---|---|
| Single | 71.47% | 71.25% | (−).0022% |
| Double | 17.50% | 17.50% | 0.0000% |
| Triple | 2.40% | 2.50% | (+).0010% |
| Home Run | 8.63% | 8.75% | (+).0012% |

It is pointed out that the spinner card 39 is removable from its base 37 so that new spinner cards 39 may be inserted as hitting percentages change from year to year. The spinner arm 40 includes a pointed end 46 which determines which sector 42 is selected when the spinner 40 comes to rest.

Figure 6:
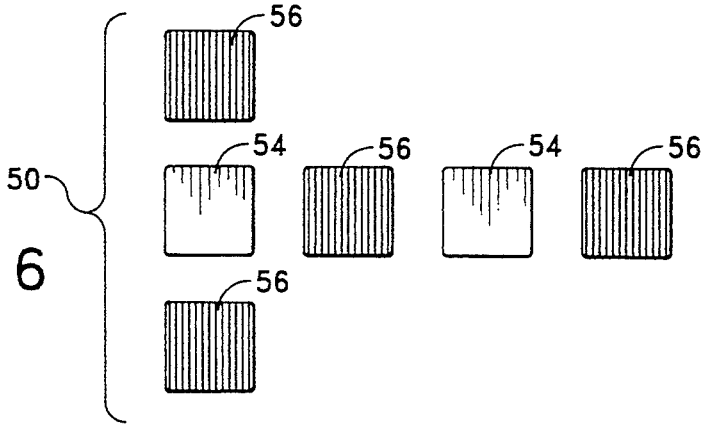
FIG. 6 is a collective view of the six sides of the first stealing die.
Figure 7:
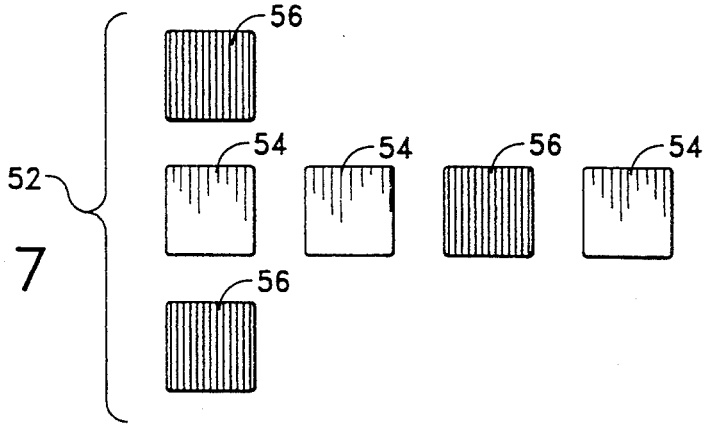
FIG. 7 is a collective view of the six sides of the second stealing die.
Figure 8:
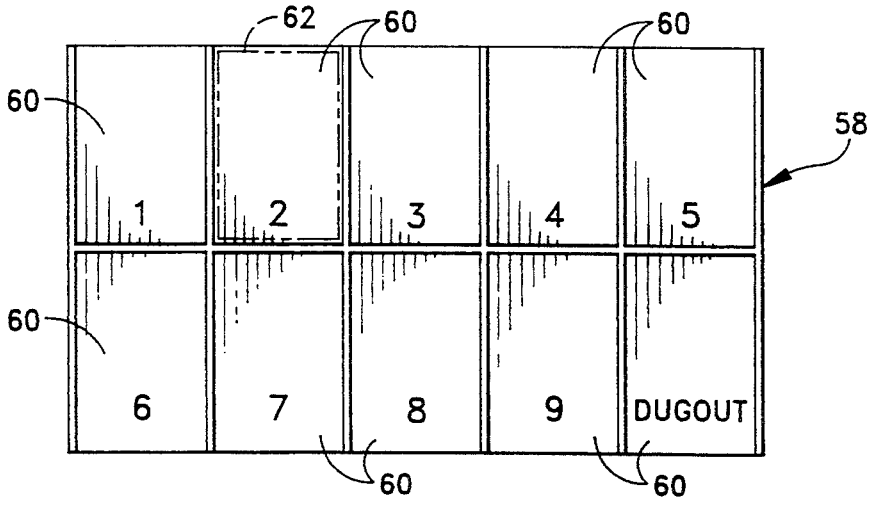
FIG. 8 is a plan view of a line-up tray for holding a player's playing cards.

The board game apparatus 10 further includes a second pair of dice generally indicated at 48 (FIG. 1) which are operable for simulating the statistical probability of a base runner successfully stealing a base. The second pair of dice 48 comprise first and second die 50 and 52 which are individually coded with specific designations so that the possible combinations of the designations determine whether the player has successfully stolen a base. More specifically, the first die 50 (FIG. 6) has a first designation 54, preferably comprising solid white, on two of its six sides, and second designation 56, preferably comprising solid black, on the remaining four sides. The second die 52 has the first designation 54 (solid white) on three of its six sides, and the second designation 56 (solid black) on the three remaining sides. The combinations of different designations on the two dice 50 and 52 when rolled determine the outcome. In this connection, if a white designation 54 appears on either of the dice 50 and 52, the result is a successful steal (24 outcomes of possible 36 (66.67%)). When both dice 50 and 52 show black designations 56 (12 outcomes of possible 36 (33.33%)) the result is an unsuccessful steal. The following Table 3 compares the results of the dice 50 and 52 versus the actual statistical averages of the Major League Baseball ® in the years 1988 and 1989:

TABLE 4

| RESULT | MAJOR LEAGUE ® | ROLLED DICE | VARIANCE |
|---|---|---|---|
| Success Rate | 68.39% | 66.67% | (−)1.73% |

The board game apparatus 10 still further includes two "line-up" trays generally indicated at 58 (only one shown), one for each player, which are operative for holding a plurality of player cards in a predetermined order for game play. The tray 58 is preferably molded from a rigid plastic wherein the tray 58 includes ten shallow openended recesses 60 distributed in a 2 by 5 array. The open ends of the tray recesses 60 are preferably angled downwardly to facilitate removal of the cards 62 from the recesses. The recesses 60 are dimensioned so as to snugly hold a conventional baseball card 62 yet allow the players to easily slide the cards 62 in and out of the recesses 60 during use. In use, the player slides the desired player cards 62 into the recesses 60 in a predetermined batting order for game play.

The board game apparatus 10 still further includes two set of fifteen fictitious baseball player cards 62 with player position and portrait 64 displayed on the face thereof. On the backside of the cards 62 is printed the word "OUT (not shown) ."

While the above sets of dice 24 and 48 have been described as including designations comprising the colors black and white, and combinations thereof, it is to be understood that the designations may be readily changed to other colors or numbers or pictures, so long as the distribution of the designations on each die is the same as shown and described herein.

PREFERRED METHOD OF GAME PLAY

The game can be played with either one or two game players using the two sets of player cards 62 provided, or the players can use their own baseball card collections to assemble a team roster. In a two player game, the players sit on opposite sides of the playing surface 12 facing each other, each maintaining their own infield and home plate direction. Each player assembles a team from their respective player cards 62 and places them in their respective tray 58 in the desired batting order. The away team player places his first player card 62, i.e. first batter, on the adjacent home plate 18 and the home team player occupies the field by placing his pitcher playing card 62 on the pitcher's mound 16 facing the batter. The away team player then rolls the first set of "at bat" dice 24 to determine the outcome of the first batter. If an out combination is rolled, the player card 62 is returned to the tray 58 in a face-down position with the word "out" displayed upwardly, and the next batter is placed on home plate to bat. Obviously, if the players own baseball cards are used for play, the statistics side of the cards will face up when an out is made. If a walk combination is rolled, the player card 62 is moved to respective first base 18 and the next player card 62 is placed on home plate 18 to bat. If a hit combination is rolled, the player spins the spinner 36 to determine the type of hit. To implement the hit, the player card 62 is then advanced to the base indicated by the spinner 36, i.e. a single (S) moves the card 62 to first base, etc. Base running is continued only on a subsequent hit or a steal attempt. On a hit, the base runners are moved the same number of bases as allowed the batter at the plate. Base runners are allowed to advance on a walk only if forced to the next base. Once a batter is on base, and if the player wishes the base runner to attempt a steal, the player must indicate to the opposing player that a steal is being attempted, and must roll the second set of "base stealing" dice 48 If a successful, or "safe" combination is rolled, the player card 26 is advanced to the next base If an unsuccessful, or "out" combination is rolled, the player card 62 is placed back in the tray 58 face-down to indicate an out. It has been found that Major League Baseball® teams usually average about two steal attempts per game. Accordingly, the rules for game play include a rule limiting the number of steal attempts to two per team per game.

When three outs occur, the away team moves to the field by placing their pitcher player card 62 on the pitching mound 16 facing the opposing home plate 18. The same procedure applies for home team batting opportunity. The players then alternate back and forth until a series of nine innings are played. Base runners left on base at the end of each batting opportunity are placed back in their original position in their tray 58 in a face-up position, and the face-down "out" cards are left in place until the next "at bat". Leaving the "out" cards in their face down position until the next "at bat" allows the player to more quickly determine the batting order for each inning of play. At the start of each inning, the batter following the last "out" card is placed at home plate for a batting opportunity, and the previous inning "out" cards are turned face up.

In a single person game, the player alternately switches from team to team for game play.

It can therefore be seen that the instant invention provides effective game apparatus 10 for accurately determining the outcome of batting and base stealing events in a baseball board game. It can be seen from Tables 1, 2, 3 and 4 above that the results of the sets of dice 24,48 and the spinner 36 are statistically quite similar to the actual results of a real Major League Baseball® game. The simplicity of the designated dice 24 and 48 and the spinner 36 makes them easy to use and interpret by children in the 4 to 10 year old age group. The first set of dice 24 determines whether the batter has achieved a hit, a walk, an out, or a strikeout. If a hit is achieved, the spinner 36 is operative for accurately determining what type of hit. If the player wishes a base runner to steal a base, a second set of dice 48 are provided for accurately determining the outcome of a base stealing attempt. Furthermore, the recessed tray 58, and replaceable player cards enable the players to use their own baseball card collections to assemble a team roster as desired. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. Apparatus for determining the outcome of events in a baseball board game comprising:

a first set of six-sided dice for determining the outcome of a batting event comprising a first die having a first designation on three sides thereof, and a second designation on three sides thereof, said first set of dice further comprising a second die having said first designation on two sides thereof, said second designation on one side thereof and a third designation on three sides thereof, wherein combinations of said designations on said first and second die represent different outcomes; and a spinner assembly for determining a type of hit once a roll of said first set of dice has determined that a hit has been achieved comprising a spinner card having a center and plurality of sectors thereon radiating outwardly from said center, each of said sectors representing a different type of hit, said spinner assembly further comprising a spinner arm rotatably mounted at the center of said spinner card.

2. The apparatus of claim 1 further comprising a second set of six-sided dice for determining the outcome of a base stealing attempt comprising a first die having a first designation on two sides thereof and a second designation on four sides thereof, said second set of dice further comprising a second die having said first designation on three sides thereof and said second designation in three sides thereof, wherein combinations of said designations on said first and second die represent different outcomes.

3. In the apparatus of claim 1, said types of hits comprising singles, doubles, triples and home runs, each of said types of hits being represented by at least one sector, said at least one sector representing singles comprising a total circumferential arc of about 256 degrees, said at least one sector comprising doubles comprising a total circumferential arc of about 63 degrees, said at least one sector comprising triples comprising a total circumferential arc of about 9 degrees, and said at least one sector comprising home-runs comprising a total circumferential arc of about 31 degrees.

4. In the apparatus of claim 3, said spinner card being divided into two substantially equal halves, each of said types of hits being represented by at least one sector in each half.

5. Board game apparatus for simulating play of a baseball game comprising:

a flat playing surface having a baseball diamond illustrated thereon;

a first set of six-sided dice for determining the outcome of a batting event comprising a first die having a first designation on three sides thereof, and a second designation on three sides thereof, said first set of dice further comprising a second die having said first designation on two sides thereof, said second designation on one side thereof and a third designation on three sides thereof, wherein combinations of said designations on said first and second die represent different outcomes;

a spinner assembly for determining a type of hit once a roll of said first set of dice has determined that a hit has been achieved comprising a spinner card having a center and plurality of triangular sectors thereon radiating outwardly from said center, said plurality of sectors representing different types of hits, said spinner assembly further comprising a spinner arm rotatably mounted at the center of said base;

a second set of six-sided dice for determining the outcome of a base stealing attempt comprising a first die having a first designation on two sides thereof and a second designation on four sides thereof, said second set of dice further comprising a second die having said first designation on three sides thereof and said second designation in three sides thereof, wherein combinations of said designations on said first and second die represent different outcomes; and two sets of player cards representing two opposing teams.

6. The apparatus of claim 5 further comprising a tray including a plurality a recessed compartments for receiving and maintaining a plurality of player cards in a predetermined order.

7. In the apparatus of claim 6, said tray including at least nine recesses.

8. In the apparatus of claim 5, said types of hits comprising singles, doubles, triples and home runs, each of said types of hits being represented by at least one sector, said at least one sector representing singles comprising a total circumferential arc of about 256 degrees, said at least one sector comprising doubles comprising a total circumferential arc of about 63 degrees, said at least one sector comprising triples comprising a total circumferential arc of about 9 degrees, and said at least one sector comprising home-runs comprising a total circumferential arc of about 31 degrees.

9. In the apparatus of claim 8, said spinner card being divided into two substantially equal halves, each of said types of hits being represented by at least one sector in each half.

10. A pair of six-sided dice for determining the outcome of a batting event comprising a first die having a first designation on three sides thereof, and a second designation on three sides thereof, said pair of dice further comprising a second die having said first designation on two sides thereof, said second designation on one side thereof and a third designation on three sides thereof, wherein combinations of said designations on said first and second die represent different outcomes.

* * * * *